US005784730A

United States Patent [19]

Hunt

[11] Patent Number: 5,784,730

[45] **Date of Patent: *Jul. 28, 1998**

[54] PATIENT LIFT/TRANSFER MECHANISMS FOR GURNEY

[76] Inventor: Dermot A. Hunt, 250 Fairfield Ct., Palatine, Ill. 60067

[ * ] Notice: The term of this patent shall not extend beyond the expiration date of Pat. No. 5,579,547.

[21] Appl. No.: 756,891

[22] Filed: Dec. 2, 1996

Related U.S. Application Data

[63] Continuation-in-part of Ser. No. 518,482, Aug. 23, 1995, Pat. No. 5,579,547.

[51] Int. Cl.[6] ..... A61G 7/10; A61G 7/14

[52] U.S. Cl. ..... 5/86.1; 5/83.1; 5/87.1

[58] Field of Search ..... 5/81.1 R–89.1

[56] References Cited

U.S. PATENT DOCUMENTS

| | | | |
|---|---|---|---|
| 2,418,606 | 4/1947 | Smith | 5/86.1 |
| 5,390,380 | 2/1995 | James-Wallace | 5/87.1 |
| 5,579,547 | 12/1996 | Hunt | 5/86.1 |

*Primary Examiner*—Alexander Grosz
*Attorney, Agent, or Firm*—Charles F. Lind

[57] ABSTRACT

The disclosed lift/transfer mechanisms have pairs of boom arms upstanding from the top surface of a patient gurney, the arms being of sufficient height and length to have the free arm ends thereof in different operative positions overlie the top surface of the gurney or an adjacent transfer support. Each boom arm end has an underlying hook for making a releasible connection via flexible straps or the like to the patient board. In one embodiment, a winch is carried on the boom arm end section, and a lift strap is released or retracted by winch operation to raise and lower boom arm hook to which the patient board is connected, and thus raise or lower the patient board and to suspend the board from the boom arms. Boom arm rotation between the operative positions shifts the suspended patient board laterally between the gurney and transfer support. In another embodiment, the boom arms are articulated to raise and lower the patient board, and further are supported on slides that can be moved laterally of the gurney top surface to shift the suspended patient board between the operative positions overlying the gurney and the transfer support.

10 Claims, 4 Drawing Sheets

PATIENT LIFT/TRANSFER MECHANISMS FOR GURNEY

RELATED APPLICATION

This is a Continuation-in-Part Application of my application Ser. No. 08/518,482 filed on Aug. 23, 1995, for Patient Lift/Transfer Mechanism for Gurney, and issued on Dec. 3, 1996 as U.S. Pat. No. 5,579,547.

BACKGROUND OF THE INVENTION

Gurneys are used in hospitals and medical or health care facilities to transport patients about, commonly while lying flat out and on the way to or from treatment or examination centers. Thus, a patient scheduled for an operation, would be carried by gurney from the patient's room to the operating room and then from the operating room via a recovery room back the patient's room. The patient must be transferred from the patient's bed to the gurney and then the operating table before the operation, and the reverse again after the operation, and such transfers traditionally have been made manually.

Many times, the patient is unconscious or otherwise is incapable of offering assistance in the transfer, so that great physical effort might be needed to lift and laterally shift the patient between the gurney and the bed or table located next to and generally aligned side-by-side with the gurney. Although only one orderly is needed to roll the gurney about the facility, several orderlies might then be needed for each manual transfer, adding to staff demands. Further, three or more orderlies might even be needed for a manual transfer if a significant mismatch in patient's weight versus orderly strength exists.

Moreover, injury risks of the orderly are increasingly of concern because of inflating cost for staff insurance and/or compensation liability, and because the potential of injury are high due to the awkward or improperly leveraged orderly movements needed for the patient transfer.

Mobile lifts, suited to be moved next to the bed, gurney or operating table, etc. on which the patient is supported, are available and have sling means that can be connected to the patient and then lifted under power for transferring the patient between the adjacent supports. However, such lifts are primarily used only for transferring the patient, and actually contain the patient for only a short duration and only at the transfer site. Thus, a different lift must be present at each transfer site, or the same lift moved between such sites along with the patient on the gurney. The need for different types of equipment at the facility increases the overall cost and space or inventory requirements of the facility.

My U.S. Pat. No. 5,579,547 covers a lift/transfer mechanism mounted on an otherwise generally conventional patient gurney, suited for lifting and transferring a patient between the gurney and an adjacent bed or operating table, etc., whereby an orderly need only roll the patient onto or off of the transfer mechanism, thereby allowing most transfers to be completed by only one orderly. A patient board is part of the lift/transfer mechanism and provides the platform upon which the patient would lie while being moved to or from the gurney, and even can stay with and support the patient during medical procedures and/or movement via the gurney throughout the facility. The lift/transfer mechanism utilized two boom arms respectively mounted at two adjacent corners of the gurney, along one long side edge near the foot and head ends thereof, that could be rotated about vertical axes, with the boom arms being curved to present upper free ends that overlie with vertical clearance the lateral center of the top gurney surface and over any patient on the patient board. Lift straps connected between the boom arms and patient board are powered by an electrical winch to lift and lower the patient board vertically as needed, including suspending it from the boom arms. With the patient board suspended, the boom arms can be rotated to laterally shift the board between opposite operative positions respectively overlying the gurney top surface or adjacent transfer surface, such as the patient's bed, operating table, etc. Slides allow lift strap movement along the boom arms to keep the suspended patient board height constant independently of the boom arm rotation incidental with this transfer. An electric storage battery carried on the gurney can allow lift/transfer mechanism operation anywhere, and outriggers can be extended laterally off of the gurney to stabilize it during the accompanying off-center shift of the suspended load.

SUMMARY OF THE INVENTION

This invention relates to and provides alternative forms of the patented gurney and patient lift/transfer mechanism, suited when mounted on an otherwise generally conventional gurney for allowing a patient to be lifted and transferred between the gurney and an adjacent support surface, requiring only that the patient be rolled onto or off of the transfer mechanism board and allowing most patient transfers to be completed by only one orderly.

A basic object of this invention is to provide a patient lift/transfer mechanism formed of off-the-shelf operating components or formed of conventional components only slightly and/or economically modified, and thereby of acceptable low cost.

Another object of this invention is to provide a gurney with a lift/transfer mechanism that satisfies the lift and transfer needs of the patient, while reducing the inventory needs of different forms of related types of equipment at the facility.

One alternative form of lift/transfer mechanism to be disclosed herein, related to my previously patented arrangement, utilizes two rotatable boom arms respectively mounted at adjacent foot and head corners of the gurney, along one long side edge thereof, with horizontally extended upper free ends that can be shifted to overlie with vertical clearance the lateral center of the top gurney surface and patient lying on the patient board thereon and an adjacent transfer surface. An electrical winch is guided to move freely along each boom arm free end, and lift straps are routed between the boom arm winches and the patient board, whereby winch operation can lift and/or lower the patient board vertically as needed, and can suspend it from the boom arms during the actual transfer between the gurney and support surface. Appropriate battery and outrigger components can be associated with the gurney to allow reliable use at different locations throughout the facility. This arrangement can be formed with more conventional and/or economically fabricated boom arm and winch structures, and with otherwise quite conventional gurneys.

Another alternative form of lift/transfer mechanism to be disclosed herein, related to my previously patented arrangement, utilizes boom arms mounted to move laterally crosswise of and approximately between the opposite long side edges of the gurney, with the upper boom arm free ends thereby being suited to be moved between positions overlying with vertical clearance the lateral center of the top gurney surface and patient and patient board thereon, and an adjacent transfer surface. A flexible strap connection is made between each boom arm free end and the patient board. The boom arm is articulated and powered to lift and lower the patient board, for suspending it from the boom arms. Lateral shifting of the boom arms provides the transfer movement of the suspended patient board between opposite operative positions respectively overlying the gurney top surface or the adjacent transfer surface.

BRIEF DESCRIPTION OF THE DRAWINGS

These and other objects, features or advantages of the invention will be more fully understood and appreciated after consideration of the following description of the invention, which includes as a part thereof the accompanying drawings, wherein.

DETAILED DESCRIPTION OF PREFERRED EMBODIMENTS OF THE INVENTION

Figure 1:
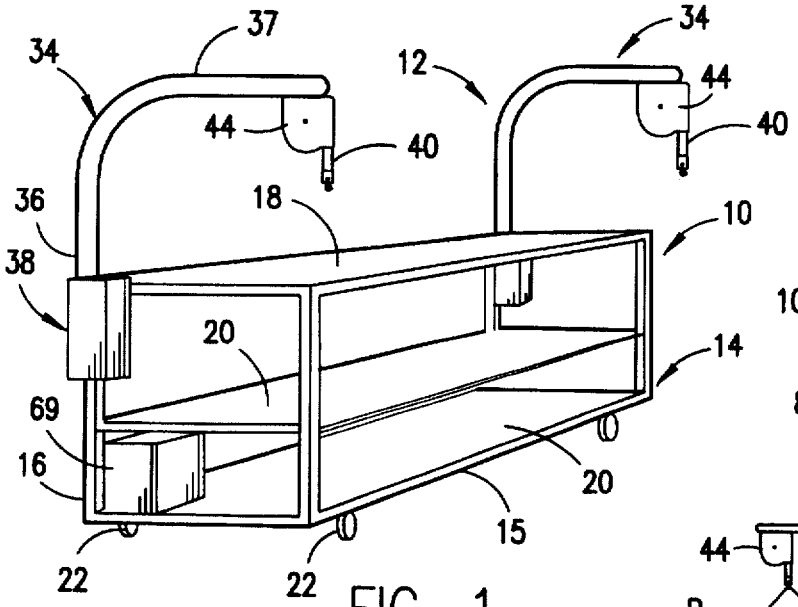
FIG. 1 is a perspective view of a gurney, shown empty, with a first embodiment of lift/transfer mechanism mounted in place thereon.
Figure 3:
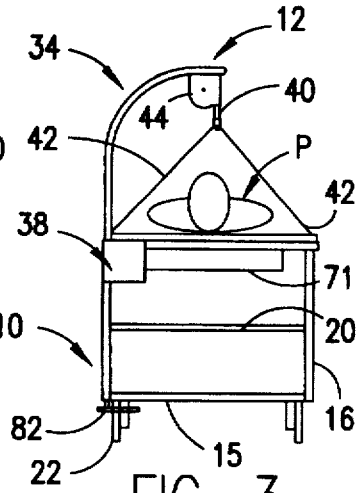
FIG. 3 is an end elevational view of the gurney and lift/transfer mechanism of FIG. 2.
Figure 2:
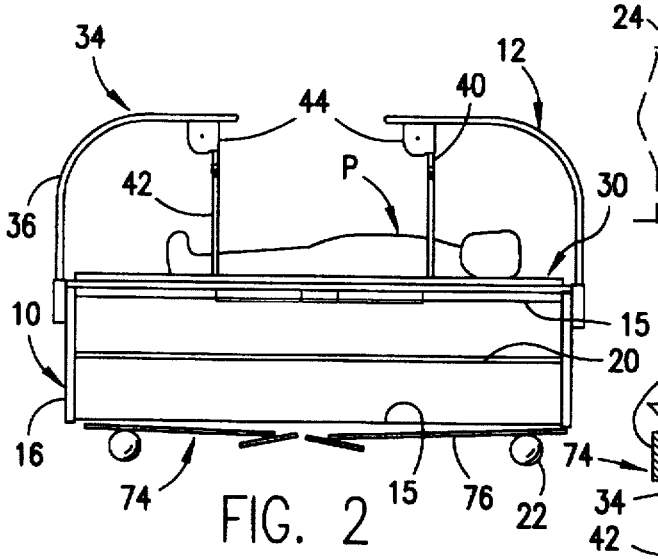
FIG. 2 is a side elevational view of the gurney and the lift/transfer mechanism, except in a different operative position and with a patient positioned thereon.
Figure 4:
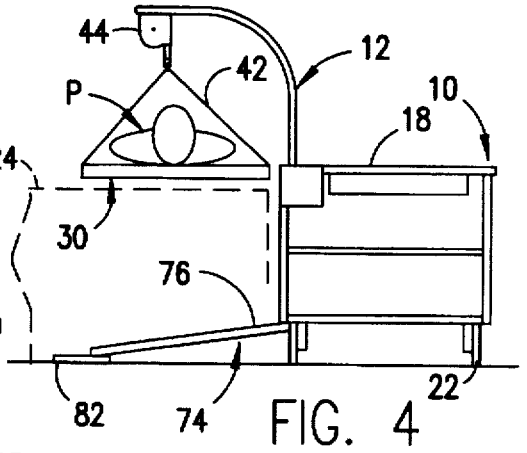
FIG. 4 is an end elevational view similar to FIG. 3, except showing the lift/transfer mechanism in a different laterally shifted operative position suited for patient transfer to or from an associated adjacent transfer surface shown in phantom next to the gurney.
Figure 8:
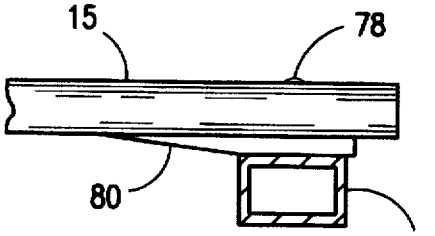
FIG. 8 is an end sectional view as taken generally from line 8—8 in FIG. 5.

As this disclosure improves on my U.S. Pat. No. 5,579,547, many components used herein will be similar to such already disclosed in detail in the patent. Accordingly, the teachings of the patent are to be incorporated by reference herein, to illustrate suitable components not specifically shown but usable herein.

FIGS. 1–5 illustrate a patient gurney 10 and patient lift/transfer mechanism 12 used thereon. The gurney 10 can be substantially conventional, with a structural frame 14 of horizontal and vertical members 15 and 16, a top surface 18 of generally rectangular shape having four corners 19, intermediate and lower shelves 20, and wheels 22. The wheels 22 would swivel about vertical axes and rotate about horizontal axes, for steering and rolling the gurney along a floor 23, and could have appropriate conventional manual and/or remote braking mechanisms (not shown). The top gurney surface 18 would be large enough to allow average size patients to be carried thereon, generally while lying flat. The lift/transfer mechanism 12 uses a separate patient board 30 on which a patient "P" would be positioned, instead of on the top gurney surface 18, and the board would also be of generally rectangular shape having long side edges 32 and short end edges 33, and would be just slightly smaller than the gurney top surface 18, suited to carry most patients thereon generally while lying flat. The patient board 30 would be supported on the top gurney surface 18 when on the gurney 10.

The lift/transfer mechanism 12 is provided to lift and transfer the patient "P" between the gurney 10 and adjacent support surface 24 (shown in phantom only in FIGS. 4 and 5) such as a bed or operating table, where an orderly need not lift the patient but only roll the patient onto and/or off of the transfer mechanism board 30, thereby allowing most transfers to be completed by only one orderly.

The illustrated lift/transfer mechanism 12 has two boom arms 34 rotatably mounted on the gurney 10 along one of its long sides near adjacent respective foot and head end corners thereof. The arms 34 are curved between generally straight end sections 36 and 37, the lower end section 36 being vertically aligned at mounting means 38, and the opposite free end section 37 being horizontally aligned and spaced well above the top gurney surface 18. Flexible lift straps 40 and 42 releasibly connect the boom arms 34 relative to the underlying patient board 30. A drive winch 44 associated with each boom arm releases or retracts each lift strap 40, to raise or lower the patient board 30 relative to the gurney top surface 18 and to suspend it from the boom arms 34.

Figure 6:
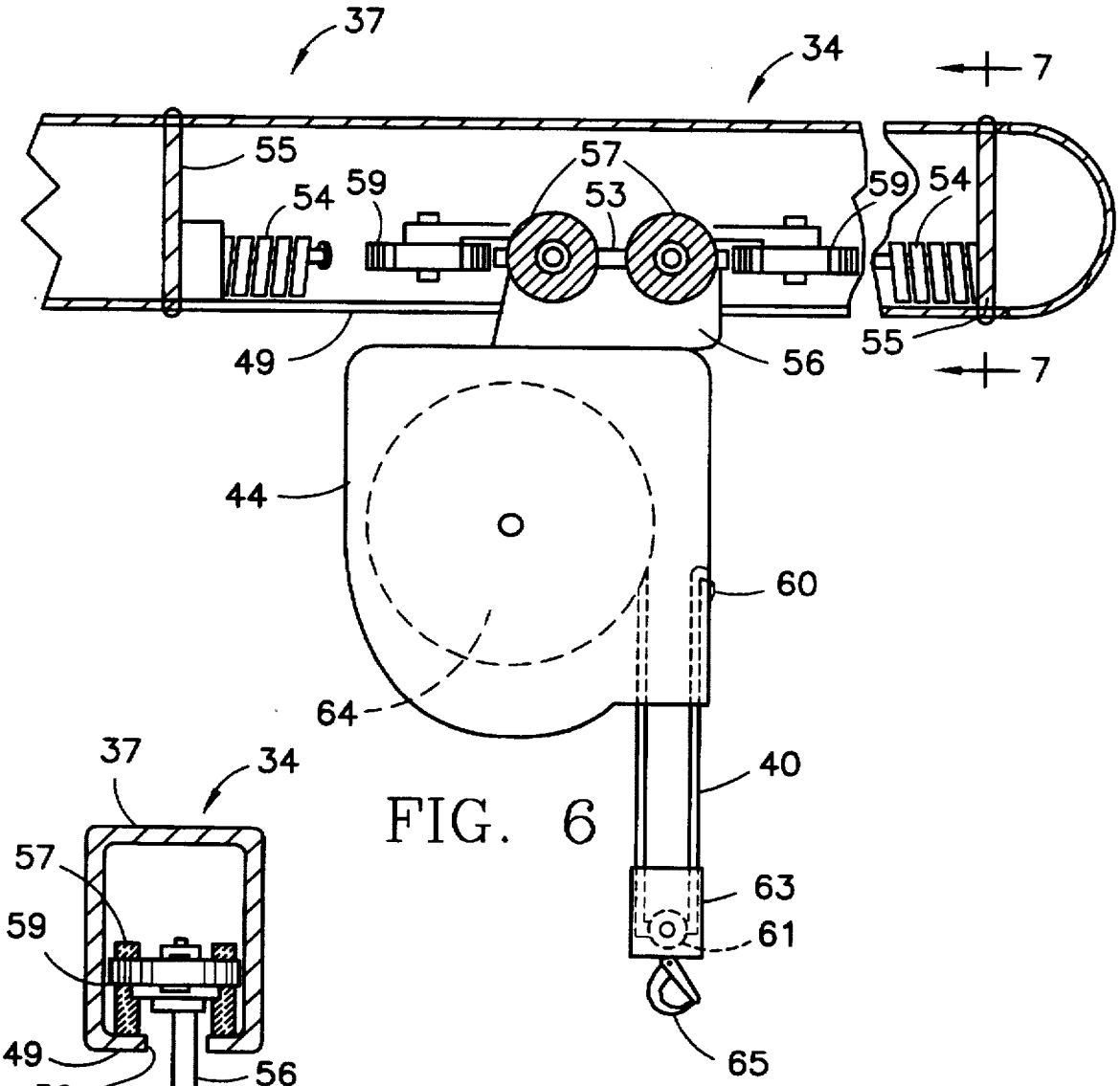
FIG. 6 is a central sectional view, enlarged compared to the previous figures, of the upper end of one of the boom arms of the lift/transfer mechanism and a winch associated therewith.
Figure 7:
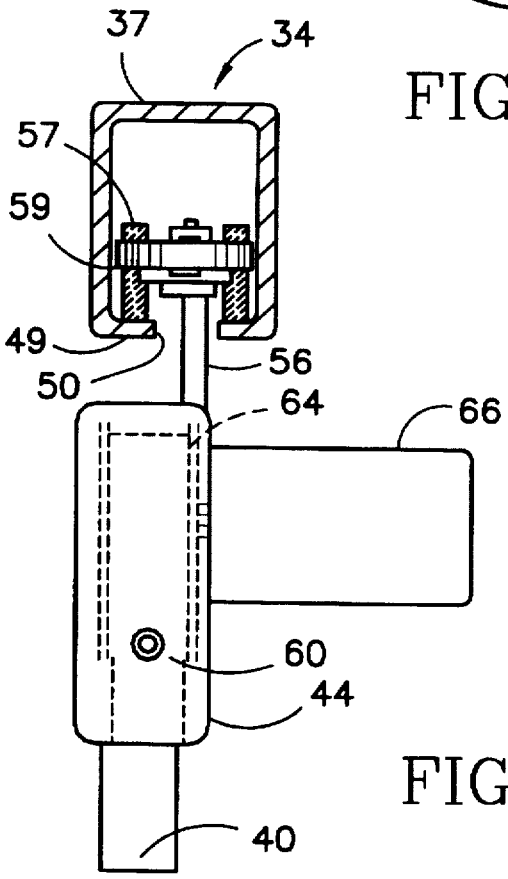
FIG. 7 is an end sectional view as taken generally from line 7—7 in FIG. 6.
Figure 9:
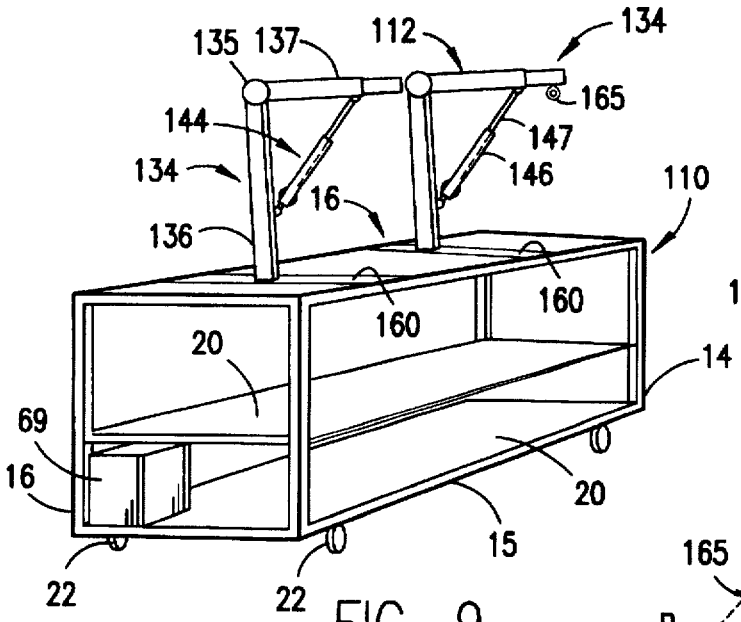
FIG. 9 is a perspective view of a gurney, shown empty, with a second embodiment of the subject lift/transfer mechanism thereon.
Figure 11:
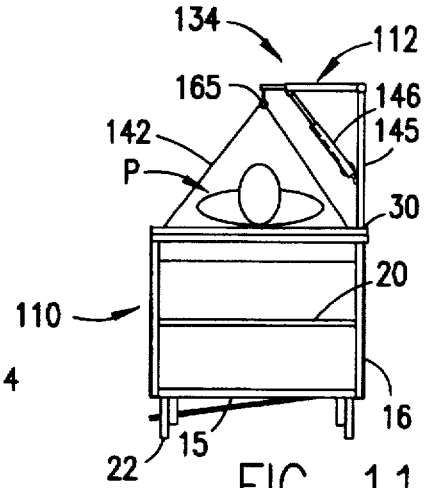
FIG. 11 is an end elevational view of the gurney and lift/transfer mechanism of FIG. 9.
Figure 10:
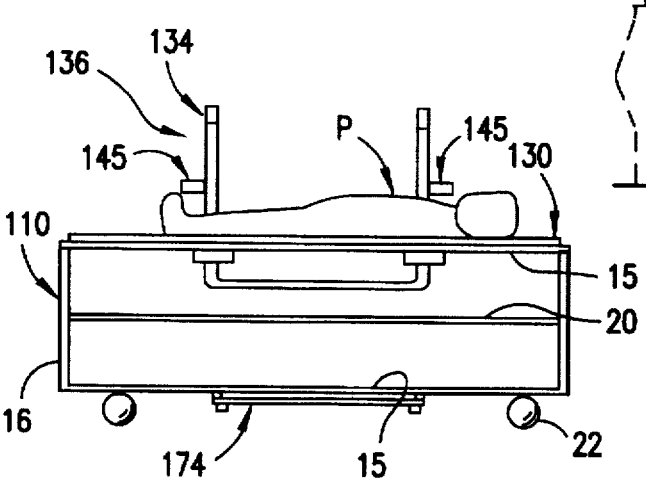
FIG. 10 is a side elevational view of the gurney and the lift/transfer mechanism, except in a different operative position and with a patient positioned thereon.
Figure 12:
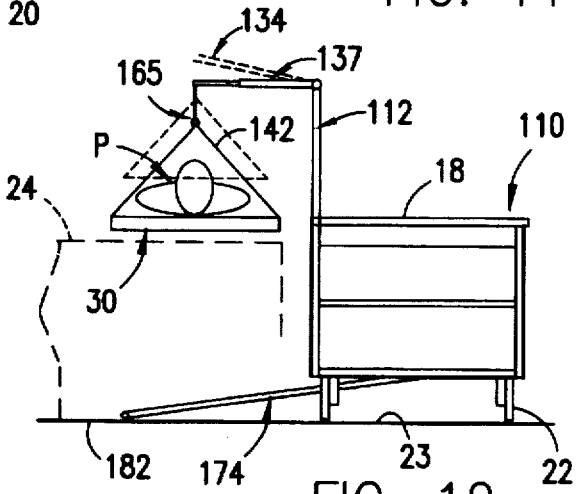
FIG. 12 is an end elevational view similar to FIG. 11, except showing the lift/transfer mechanism in a different position laterally shifted to be suited for patient transfer to or from an associated adjacent transfer surface shown in phantom next to the gurney.

As FIGS. 6 and 7 illustrate, the upper end 37 of each boom arm 34 is formed as a hollow-channel, with peripheral top, side and bottom walls, including bottom wall ledges 49 on opposite sides of elongated slot 50. Slide 52 is guided to move within each boom arm end 37, with spring bumpers 54 mounted off boom arm cross walls 55 provided to be hit by the slide at the opposite limits of slide movement within the boom arm. A structural web 56 formed off of the slide 52 is fitted through the slot 50 for supporting the winch 44 to move also along the underside of the boom arm end 37. The slide 52 is illustrated as a wheeled car having a frame 53 supporting four spaced wheels 57 that roll, two each, along each ledge 49 and two spaced rollers 59 that can roll along either side walls for minimizing side-to-side slide movement within the boom arm.

The strap 40 has one end connection 60 to the frame of winch 44, and is trained around roller 61 in block 63 and directed back to and rolled onto and off of a winch spool 64 at its opposite end. Each winch spool 64 is preferably driven by a reversible electrically powered gearmotor drive 66, to retract or release the strap 40 in order to shift the patient board vertically to different heights relative to the top gurney surface 18 or spacings below the boom arm end section 37. A battery 69 (FIG. 1) carried on the gurney 10 can electrically power the winches 44 for providing lift/transfer mechanism operation anywhere the gurney can go. The separate winches 44 can be driven in synchronization by means of conventional master-slave controls, and can be operated by directional on-off switches contained on a gurney panel 71 (FIG. 3) or in a portable hand control (not shown).

Figure 5:
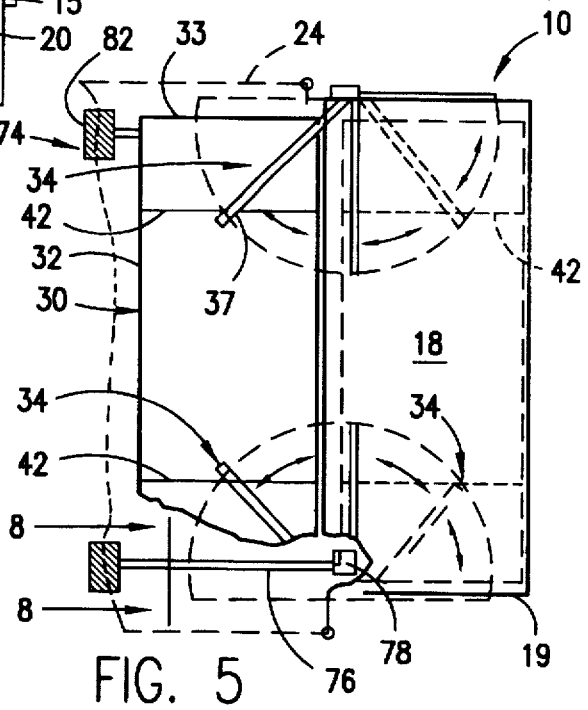
FIG. 5 is a top plan view of the gurney and lift/transfer mechanism of FIG. 4, with the associated transfer surface.

Each boom arm end section 37 is sufficiently long to overlie the approximate lateral center of the gurney top surface 18 and an adjacent transfer surface 24 located in side-by-side association with the gurney 10, when the boom arms 34 are rotated to the operative positions illustrated in FIG. 5: the phantom illustration showing the free ends 37 angled inwardly over gurney top surface 18, and the solid illustration showing the free ends angled outwardly away and spaced from the gurney top surface and over adjacent transfer surface 24.

An eyelet or hook 65 is connected off of the block 63, to provide means for establishing releasible connections via hooks or eyelets on the ends of strap 42 to the patient board 30 at intermediate locations along its length, and at locations that generally underlie the slides 52 on the boom arms 34, when the boom arms are properly rotated. Once the arm-board connections are set, winch activation can elevate the patient board 30 and suspend it from the boom arms 34. With the patient board 30 so suspended, boom arm rotation can laterally shift the patient board between the opposite operative positions respectively overlying the gurney top surface 18 or adjacent transfer surface 24. However, the slides 52 can roll along the boom arm end sections 37 to correspond to and remain at the same separation of the board straps 42 along the patient board 30, so that the straps 40 and 42 will remain generally vertical and the patient board vertical height or spacing from the boom arm will remain substantially constant during this transfer.

Outriggers 74 can be carried on the underside of gurney 10 suited to be shifted between stored positions (FIGS. 1–3) under the lower shelf 20 and operative deployed positions (FIGS. 4 and 5) projected laterally of the gurney for stabilizing the off-center gurney loads occasioned during the transfer of a suspended patient. Each outrigger 74 can include an arm 76 mounted at inboard end structure 78 to pivot about a substantially vertical axis near the gurney ends and sides, generally below the boom arms mountings 38, with support foot 82 on the outboard end of each arm for resting against the floor 23.

While the outrigger arms swing in a generally horizontal plane through most the arc traversed between the stored and deployed positions, a cam 80 in the pivot structure 78 can wedge the arm out of this plane to be slightly inclined downwardly toward the floor when deployed, for planting the foot 82 firmly against the floor. The pivot structures 78 can be spaced apart a distance less than the leg separation (not shown) of the transfer bed, table, etc. comprising the transfer surface 24, to allow the outriggers to fit therebetween when deployed and when the gurney and transfer surface are in the adjacent side-by-side transfer relationship (FIG. 5).

Preferred straps 40 and 42 would be durable, flexible and nonextendable, such as of nylon webbing or the like. The straps 42 can be connected to the patient board by conventional quick release hooks cooperating with appropriately located receiving openings (neither being shown) provided along the board. Conventional patient securing straps (not shown), similar to such provided on a conventional gurney and/or patient stretcher, could be provided on the board for added patient safety and security.

Different types of patient boards 30 could be provided for use in specific departments of a medical facility. For example, the patient board could be padded or unpadded, could be made to sterilized standards and sealed in packages suited for sterile operation rooms, or could be made of materials suited for X-rays, imaging or therapy. The boards or wrappings could be color coded, and a number of such patient boards could be carried about on the gurney, on the shelf 20 for example, and after use could be cleaned, repackaged and reused.

A patient thus could be placed on the board 30 at the patient's room and moved via the gurney 10 to a specific medical department for treatment, examination, tests, surgery, etc. or the like, which might take place with the patient still on the board, and the patient could be returned to the patient's room without ever leaving the board.

This disclosed lift/transfer mechanism 12 provides that the boom arms 34, winch 44 and slides 52 can be economically and easily fabricated from conventional components, of structural steel, plastic or the like, particularly with respect to the structural but simplified beam end section 37. The exposed surfaces of the boom arms and other associated components could be plastic coated for sanitary or safety reasons, if deemed appropriate.

The vertical height of the end section 37 above the gurney top surface 18 might be approximately 20–30 inches, the circular reach of the end section 37 and hook 65 from the boom arm mounting 38 might be approximately 25–35 inches, and the travel of each slide 52 might be approximately 8–12 inches.

Safety controls can be implemented in the lift/transfer mechanism on the gurney, such as an interlock that would preclude operating of the winch 44 unless the outriggers 74 have been deployed. Also, a low charge battery alarm or a patient overload alarm could be provided.

FIGS. 9–15 illustrate an alternative patient gurney 110 and patient lift/transfer mechanism 112 usable thereon. The gurney 110 can have many of the same structural components disclosed above with respect to the gurney 10 of FIGS. 1–8, and the same reference numbers will be used for them, and only different components will identified by different reference numbers.

Specifically, the illustrated lift/transfer mechanism 112 has two boom arms 134 each comprised of generally straight lower and upper end sections 136 and 137 pivoted together at connection 135. Each lower end section 136 is held vertically aligned by mounting structure 138, and the mounting structure is connected to and carried by a slide 152 to move laterally crosswise of and approximately between the opposite long side edges 32 of the gurney top surface 18. Each upper end section 137 is angled transverse to its connected lower section 136, and will be vertically spaced above the top gurney surface 18 when the end sections are approximately normal to one another. This will allow the boom arm upper end sections to pass with clearance over a patient lying on the patient board 30 that is supported on top gurney surface 18. Flexible lift straps 142 connected to the underlying patient board 30 can be releasibly connected to the boom arm upper end sections 137 at hook or eyelet 165. Each end section 137 can be comprised of telescoping members if desired, for yielding added operative length while yet having a compact nonuse or storage space.

A linear power drive 144 is connected at pivot mounts 141 and 143 between the articulated end sections 136 and 137 of each boom arm, and when actuated varies its length to thereby extend or retract the spacing between the pivot mounts. This changes the angle between the end sections 136 and 137, and thereby raises or lowers the connected patient board 30 relative to the gurney top surface 18, including suspending it from the boom arms 134. The power drive 144 might typically be comprised of telescoping structural members 146 and 147, with an electrical transducer mounted in the larger member 146 and having a worm or screw (not shown) rotated by motor 145 and a gear follower (not shown) connected to the smaller member 147 and driven by the rotating screw to extend or retract the smaller member within the larger member. The separate motors 145 of the drives 144 can be powered electrically by the storage battery carried on the gurney, so as to yield lift/transfer mechanism operation anywhere the gurney can go. The motors 145 further can be driven in synchronization by means of conventional master-slave controls, and can be operated reversibly by directional and on-off switches (not shown).

Each slide 152 is guided to move crosswise of the top gurney surface 18 along gurney channel structure 157 having spaced side walls and a cross wall having spaced ledges 159 separated by elongated slot 158. Each slide 152 is illustrated as a wheeled car having a frame supporting four spaced axles 154, each axle in turn supporting two wheels 155 suited to roll along the upper side or the lower side of the ledges 159, and end rollers 156 that can roll along either side walls for minimizing side-to-side slide movement within the channel structure. A structural web 166 rigid with the slide frame is fitted through a slot 160 in the top gurney surface for supporting via mounting 138 the lower boom arm 136 above the top gurney surface. The simultaneous slide wheel contact on opposite upper and lower sides of the channel ledges, and the spacing of the wheels 155 from one another, provide slide stability against the off-center loading of a suspended patient board. Spring bumpers 54 (only one being shown) mounted off channel cross walls can be provided to limit slide movement.

Lateral shifting of the slides 152 and with them the boom arms 134 carried thereon, provides for a transfer of a suspended patient board between opposite operative positions respectively overlying the gurney top surface 18 or adjacent transfer surface 24. The upper boom arm 137 is sized, when the slides 152 are moved between the opposite positions adjacent the opposite sides 32 on the top gurney surface, to overlie with vertical clearance the lateral center of the top gurney surface 18 and patient board thereon, and an adjacent transfer surface 24. A linear power drive 164 can be connected between the separate slides 152 to move them under power and in unison across the gurney, the drive 164 illustrated being comprised of a worm or screw 168 mounted nonrotatably in the gurney, and a follower block 172 carrying a gear (not shown) rotated by motor 170 to be driven along the length of the screw 168, and arms 178 connected between the follower block and the separate slides 152. The motor 170 of the drive 164 can be powered electrically by the storage battery carried on the gurney, so as to yield lift/transfer mechanism operation anywhere the gurney can go, and can be reversibly by directional and on-off switches (not shown).

Figure 13:
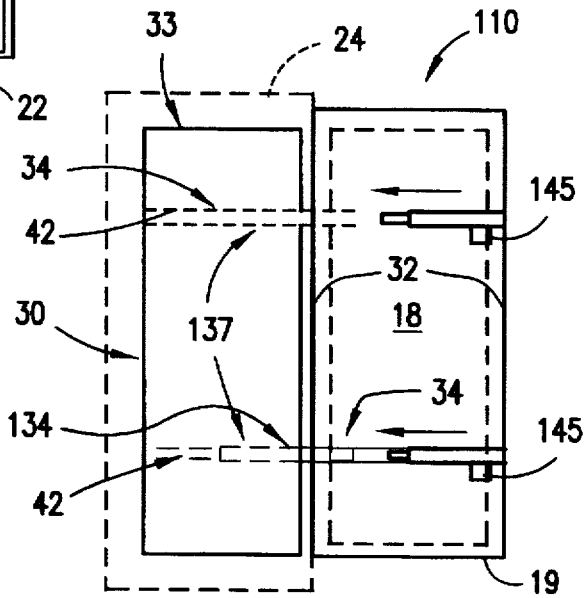
FIG. 13 is a top plan view of the gurney and lift/transfer mechanism of FIG. 12, with the associated transfer surface.
Figure 14:
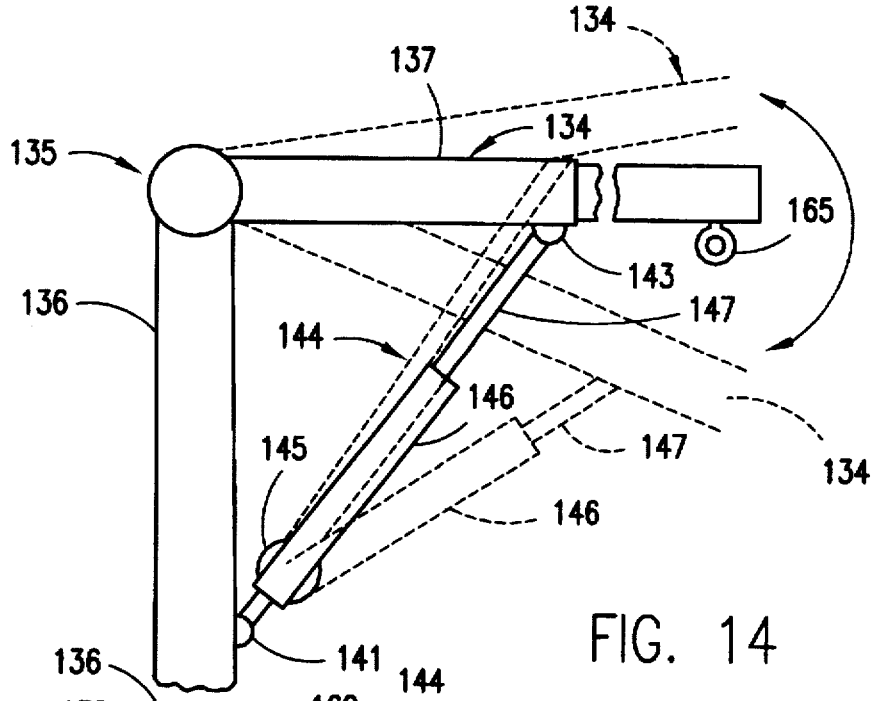
FIG. 14 is a central sectional view as seen from line 14—14 in FIG. 16, enlarged compared to the previous figures, of one laterally moveable slide and mount for the lift/transfer mechanism.
Figure 16:
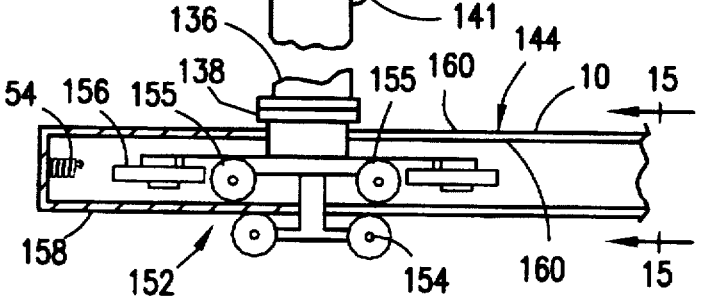
FIG. 16 is a bottom plan view of the gurney and boom arm slide of FIG. 14, except showing details of a drive for shifting the boom arms crosswise to the gurney.
Figure 16:
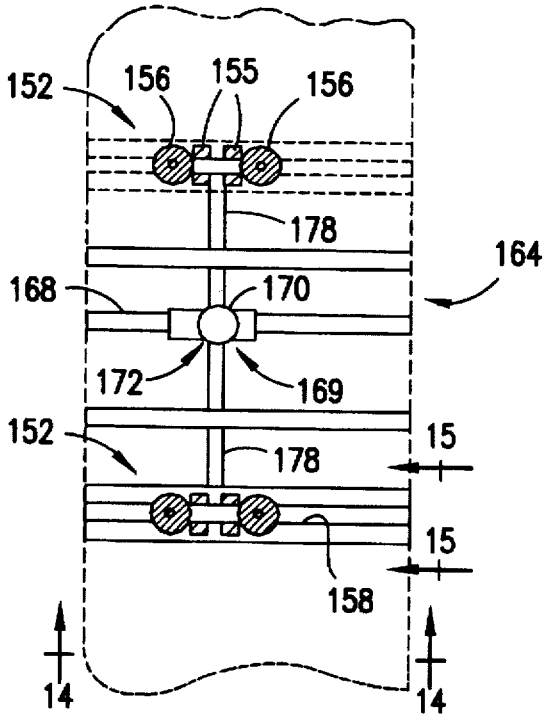
Figure 15:
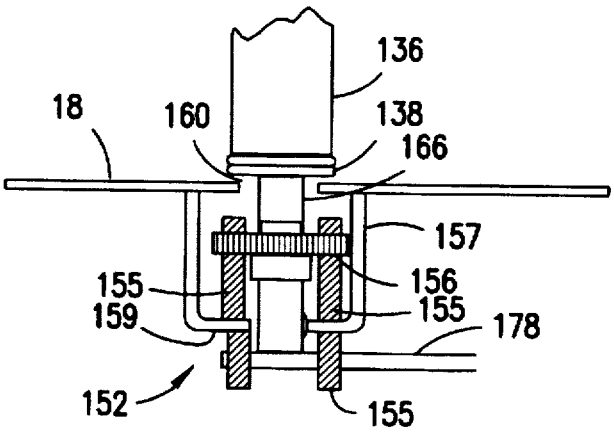
FIG. 15 is an end sectional view as taken generally from line 15—15 in FIG. 16.

Outrigger structure 174 can be carried on the underside of gurney suited to be shifted between a stored position (FIGS. 9–11) under the lower shelf 20 and an operative deployed position (FIGS. 12 and 13) projected laterally of the gurney for stabilizing the off-center gurney loads occasioned during the transfer of a suspended patient. The outrigger 174 can include two pairs of telescoping members, one member of each pair being secured to the gurney framing 15 between the gurney ends and the other member of each pair being shiftable relative to its telescoping member and having thereon a support foot 182 for resting against the floor 23. The outrigger structure 174 will be sized less in the direction along the length of the gurney than the leg separation (not shown) of the transfer bed, table, etc. comprising the transfer surface 24, to allow the outrigger structures to fit therebetween when deployed and when the gurney and transfer structures are in the adjacent side-by-side transfer relationship (FIG. 13).

Suitable hand crank drives (not shown) might be provided instead of the powered winch 44 or linear motors 144 and 164, for manual operation by the orderly.

The channel support for the slides 152 are shown separated along the length of the gurney 110, at an intermediate spacing generally corresponding to the spacing along the patient board of the straps 142. Thus, the boom arms need not rotate about the vertical axes defined by the lower end sections 136, and the mounting structures 138 can be made rigid or even eliminated and the lower arm section 136 and structural web 166 can be integral with one another. Alternatively, mounting structures 138 can be comprised with bearing means (not shown) to allow boom arm rotation about the vertical axis through the lower end section 136, so as to pass the support hook or eyelet 165 somewhat lengthwise of and along the long sides 32 of the gurney 110. Further then, the channels 157 for supporting the laterally shiftable slides 152 can be made closely adjacent the head and foot ends of the gurney. Also, the boom arms 34 with the power winches 44 thereon could be carried laterally by the slides 152 to yield a gurney with most versatile lift/transfer mechanism, and possible movements of a suspended patient board. This would include, but not be limited to benefits or advantages, of allowing use of the gurney on either side of a transfer surface and without regard to any head or foot end as the patient may be lying thereon, as well as allowing lengthwise shifting or slight rotation of the patient board in the transfer between the gurney and transfer surface.

While specific embodiments have been illustrated, it will be obvious that minor changes could be made therefrom without departing from the spirit of the invention. Accordingly, the invention is to determined by the scope of the following claims.

What is claimed is:

1. For a gurney having side edges terminating near spaced corners, and corner wheels movably supporting the gurney, a lift/transfer mechanism for shifting a patient between the gurney and an adjacent transfer structure disposed side-by-side next to the gurney, comprising a patient board suited for carrying a patient and be removably supported on a gurney top surface, a pair of boom arms each having generally straight lower and upper end sections angled relative to one another, and means mounting the boom arms at corresponding lower end sections to the gurney near the gurney top surface, each boom arm upper end section being sized when the lower end section is positioned near one side edge to overlie the gurney top surface, patient board and any patient thereon, and each boom arm upper end section having a hook carried thereby to likewise overlie the gurney top surface in this operative position;

flexible nonextendable straps and means for releasibly connecting the straps between and relative to the patient board and the boom arm hooks;

means for raising and lowering the boom arm hooks and the patient board connected thereto and for suspending said board below and from the boom arm upper end sections; and means for shifting the boom arms to a different operative position whereby the boom arm hooks and the patient board suspended therefrom are laterally shifted to overlie an adjacent transfer structure disposed side-by-side next to the gurney.

2. A lift/transfer mechanism according to claim 1, further wherein said means for raising and lowering the boom arm hooks and the patient board connected thereto comprise a winch connected relative to each of the boom arm upper end sections and having an operative spool, and flexible straps operating between the winch spool and the hooks and suspending the hooks below the boom arm upper end sections whereby winch operation retracting or releasing the strap relative to the winch spool for raising and lowering the boom arm hooks relative to the boom arms upper end sections.

3. A lift/transfer mechanism according to claim 1, further wherein the means for shifting the boom arms to a different operative position includes means mounting the boom arms at corresponding lower end sections to the gurney near the corners on one side edge to allow boom arm rotation with the boom arm upper end sections being respectively angled to vertically overlie the gurney top surface and the adjacent transfer structure, whereby the hooks carried thereby and the patient board suspended therefrom are laterally shifted between overlying the transfer structure or the gurney.

4. A lift/transfer mechanism according to claim 3, further comprising the boom arm upper end sections having guide pathways, and slides mounted to move along the guide pathways as the boom arms are shifted between the operative positions, to hang thereby the straps along generally vertically orientations extended when between the hooks and the underlying patient board.

5. A lift/transfer mechanism according to claim 4, further wherein said means for raising and lowering the boom arm hooks and the patient board connected thereto comprise a winch connected relative to each of the boom arm upper end sections and having an operative spool, and flexible straps operating between the winch spool and the hooks and suspending the hooks below the boom arm upper end sections, winch operation retracting or releasing the strap relative to the winch spool for raising and lowering the boom arm hooks relative to the boom arms upper end sections.

6. A lift/transfer mechanism according to claim 1, further wherein the means for shifting the boom arms to different operative positions comprise guide pathways on the gurney extended cross-wise generally between the gurney opposite side edges, slides mounted to move along the guide pathways, and means connecting the boom arm lower end sections relative to the slides, operable as the slides are moved along the guide pathways to shift the boom arms laterally of the gurney between the operative positions.

7. A lift/transfer mechanism according to claim 1, further wherein said means for raising and lowering the boom arm hooks and the patient board connected thereto comprise a pivot connection between the boom arm lower and upper end sections to pivot the upper end section generally along vertical planes, the lower end section being oriented generally vertically and the upper end section being oriented transversly thereto, and extendable power means connected between the boom arm end sections spaced from the pivot connection operable when operated to change the angle of orientation of the end sections relative to one another.

8. A lift/transfer mechanism according to claim 7, further wherein the means for shifting the boom arms to different operative positions comprise guide pathways on the gurney extended cross-wise generally between the gurney opposite side edges, slides mounted to move along the guide pathways, and means connecting the boom arm lower end sections relative to the slides, operable as the slides are moved along the guide pathways to shift the boom arms laterally of the gurney between the operative positions.

9. A lift/transfer mechanism according to claim 8, further wherein means connect the boom arm lower end sections rotatably relative to the gurney, operable to have the boom arms swing about generally vertical axes, for orienting the hooks over limited ranges as desired relative to and overlying the transfer structure or the gurney.

10. A lift/transfer mechanism according to claim 7, further wherein power means connected between the gurney and slides for shifting the slides under controlled power to different operative positions.

* * * * *